US007014332B2

(12) United States Patent
Sergio et al.

(10) Patent No.: US 7,014,332 B2
(45) Date of Patent: Mar. 21, 2006

(54) STRUCTURAL DEVICE APPLIED TO CEILING LUMINARIES, LAMPS OR LAMP FIXTURES

(75) Inventors: Ronnie L. Sergio, S.J. Rio Preto (BR); Robin S. Sergio, S.J. Rio Preto (BR)

(73) Assignee: VR Lux Industrial, Ltda., (BR)

( * ) Notice: Subject to any disclaimer, the term of this patent is extended or adjusted under 35 U.S.C. 154(b) by 0 days.

(21) Appl. No.: 10/884,596

(22) Filed: Jul. 2, 2004

(65) Prior Publication Data

US 2004/0240213 A1 Dec. 2, 2004

(30) Foreign Application Priority Data

May 23, 2003 (BR) ..... MU-8301261
May 23, 2003 (BR) ..... MU-8302479
May 23, 2003 (BR) ..... MU-83012540

(51) Int. Cl.
*F21S 8/00* (2006.01)

(52) U.S. Cl. ..... 362/147; 362/222; 362/408; 362/249

(58) Field of Classification Search ..... 362/147, 362/148, 221, 217, 222, 404, 408, 249; 248/345, 248/318, 343
See application file for complete search history.

(56) References Cited

U.S. PATENT DOCUMENTS 2,346,315 A * 4/1944 Levy ..... 362/221
4,222,093 A * 9/1980 Garcia et al. ..... 362/147
6,305,816 B1 * 10/2001 Corcorran et al. ..... 362/147

* cited by examiner

*Primary Examiner*—Sandra O'Shea
*Assistant Examiner*—Sharon Payne
(74) *Attorney, Agent, or Firm*—Robert C. Kain, Jr.; Fleit Kain

(57) ABSTRACT

The luminary, lamp or lamp fixture includes, in one embodiment, a cover plate for an outlet having a hook extension on one side and a L-bracket on the other permitting a canopy, first to rotatably swing on the plate to permit attachment of lamp wires, and then to affix the canopy to the plate via the L-bracket. In a further embodiment, the luminary or lamp fixture has an upper and a lower trough wherein the upper trough defines a wire channel through which runs wires, A plate closes the wire channel by fixing tabs. In another embodiment, a plate with C-shaped edge sections clips into the wire channel.

15 Claims, 5 Drawing Sheets

STRUCTURAL DEVICE APPLIED TO CEILING LUMINARIES, LAMPS OR LAMP FIXTURES

TECHNICAL FIELD

This utility model patent application consists of a mounting device especially developed to be applied to ceiling luminaries (lamps and lamp fixtures) in general, which makes the lamp fixture easier to install and conduct occasional maintenance. It enables perfect, safe, efficient and fast installation, since its structural aspects are simple. It is a useful, efficient and low-cost product for its industrial feasibility, and it also has other characteristics that make it a novelty for the purpose for which it was created.

In another embodiment, the proposed utility model patent application is a set of elements intended to be used in luminaries (lamps and lamp fixtures) and the like, such as an upper trough fitted with a wire channel and a wiring-protection profile, notably developed in order to provide more protection to electrical components of luminaries such as ballasts and connection terminals, and to prevent the user from coming into contact with those components. As a consequence, it also provides a longer useful life to the wiring and electrical components of luminaries. Moreover, it brings innovative and modern characteristics to luminaries offered in the market and is a very useful, efficient and low-cost product for its industrial feasibility.

In a third embodiment, the upper trough is fitted with a wire channel and a wiring-protection profile, notably developed in order to provide more protection to electrical components of luminaries such as ballasts and connection terminals, and to prevent users from coming into contact with them. As a consequence, it also provides a longer useful life to the wiring and electrical components of luminaries. Moreover, it brings innovative and modern characteristics to luminaries offered in the market and is a very useful, efficient and low-cost product for its industrial feasibility.

TECHNICAL PRINCIPLES AND BACKGROUND OF THE INVENTION

As it is public knowledge, the market, especially that of electrical materials and equipment, is filled with a great variety of luminary models and other electrical elements developed in order to be installed on the ceiling of homes, commercial, industrial establishments, etc. However, mounting devices that are usually part of the luminary set are old-fashioned and difficult to handle, what makes it take longer to install and not always results in good finishing and functionality.

Such devices are usually composed of a common metal plate equipped with, at least, two side holes through which fixing means, commonly consisting of screws or even flexible cables, pass to be fixed to the ceiling or outlet box. Such metal plate has a central threaded hole designed to fix the luminary to the ceiling through screws.

There are also other fixing means used in luminaries, such as a fixing system that consists of a steel plate with an oblong hole for fixing it to the ceiling. Instead of having a threaded hole, it has rectangular end cuts and end L-shaped rabbets, forming "hooks" that fit into the openings made on the fixing plates of the luminary. The plate is appropriately fixed to the luminary in such a way as to enable it to be turned, so that clips from the mounting device are introduced into the oblong semi-circular holes for fixing it.

The fixing means cited above makes the installer have to turn the luminary, what might turn all the wiring of the set. This may lead to the rupture of wires, short circuits, or even damage of components of the set.

There are also fixing means of luminaries and the like that are extremely difficult to handle, because they are composed of so many independent elements, which, however, depend on each other for enabling a good installation.

Other publicly known luminary models have a trough-shaped body that holds all the electrical components of the luminary, such as wiring, connection terminal supports, and ballasts. In this manner, lamp connectors and wiring remain exposed.

Besides the difficult and slow maintenance this model requires, since all the set needs to be dismantled for maintenance, it also shortens considerably the useful life of connection terminals and wiring.

As state-of-the-art techniques evolved, a single-structured trough-shaped luminary was developed with a longitudinal opening for fitting lamp(s) and end terminals, through which maintenance of components such as connection terminals, wiring, and lamps may be conducted. However, this model does not have appropriate space to hold and protect wiring, so wires remain exposed to the heat of ballasts and UV rays from lamps.

OBJECTS OF THE INVENTION

It is an object of the invention to provide a luminary or lamp or lamp fixture which is easy to install.

It is another object of the present invention to provide a shield for wiring in the lamp or lamp fixture.

SHORT DESCRIPTION AND SUMMARY OF THE INVENTION

Concerned about the inconveniences cited above and interested in improving products offered in the market, after a lot of research the inventor developed this mounting device intended to be used in luminaries and the like. In one embodiment, the system is composed of two parts: one is a stamped (preferably) metal plate equipped with at least three circular holes for passing wires and two sets of oblong symmetric concentric holes used for fixing the luminary or lamp fixture to the ceiling or outlet box; the other one is two extensions of the metal plate placed on opposite sides of the plate. One plate extension is a hook-shaped extension intended to hold the canopy while the installer connects the wires; the other plate extension is an L-shaped extension with a threaded hole for screwing the installation device to the canopy. For fixing this mounting device to the canopy, the canopy must be open on top and have a side rectangular slot appropriate to receive the hook extension from the mounting device (plate), and have a preferably round hole equipped with a screw, which screw must be appropriate for fitting into the hole of the L-shaped extension of the mounting device (plate).

For fast and efficient installation, the plate mounting device should first be fixed to the ceiling by fixing elements that go through the holes of the said device, whose function is to hold the canopy.

The rectangular slot on the side of the canopy fits into the side hook extension of the plate mounting device, and this aligns the hole of the canopy with the hole of the L-shaped extension on the opposite side of the mounting plate, but the canopy should not yet be completely screwed to the mounting device.

Next, all the installer has to do is to connect the wires, rotate the canopy up to align the screw holes of the mounting plate and the L-shaped extension, insert the screw and close the canopy by screwing it to the mounting device.

In this manner, an efficient and fast installation may be obtained without the need of assistance.

Another embodiment of the invention is a structural device introduced into a trough profile with a wire channel and a wiring-protection profile intended to be used in luminaries (lamps and lamp fixtures) and the like. This device consists of an upper trough made from a preferably rectangular metal plate shaped through stamping or another appropriate process in such a way as to form a rectangular prism-shaped longitudinal wire channel intended for holding lamp wiring.

For effective protection of the wires that run in the channel obtained from the said protrusion, a metal plate with longitudinally-folded "C"-shaped edges is applied and fixed to the inner surface of the trough, in order to hold and protect wiring. It may be fixed through pressure or sliding, which makes it easy to conduct any necessary maintenance.

The wire channel has been conceived to hold and protect all the wiring necessary for connecting the components of the luminary or lamp fixture and to receive all the supports for fixing terminals of lamps and ballast supports. It also allows the application of appropriate reflective materials like PVC film with aluminum coating, in order to better reflect luminosity, thus helping to save electric energy.

The upper trough is made in such a way as to allow the end lower trough that closes the luminary set to slide through longitudinal edge rails or edge folds of the upper trough and make them fit in to one another.

In a further embodiment, a structural device is introduced into a trough profile with a wire channel and a wiring-protection profile intended to be used in luminaries (lamps and lamp fixtures) and the like. This device consists of an upper trough made from a preferably rectangular metal plate shaped through stamping or another appropriate process in such a way as to form a rectangular prism-shaped longitudinal wire channel intended for holding wiring.

For effective protection of the wires that run in the channel obtained from the said protrusion, a metal plate with longitudinally-folded "C"-shaped edges is applied and fixed to the inner surface of the trough, in order to hold and protect wiring. It may be fixed through pressure or sliding, which makes it easy to conduct any necessary maintenance.

The wire channel has been conceived to hold and protect all the wiring necessary for connecting the components of the luminary and to receive all the supports for fixing terminals of lamps and ballast supports. It also allows the application of appropriate reflective materials like PVC film with aluminum coating, in order to better reflect luminosity, thus helping to save electric energy.

The upper trough is made in such a way as to allow the end lower trough that closes the luminary set to slide through longitudinal edge rails or edge folds of the upper trough and make them fit in to one another.

BRIEF DESCRIPTION OF THE DRAWINGS

Further objects and advantages of the present invention are set forth below when taken in conjunction with the accompanying drawings. In order to complement this description and provide better understanding of the features of this system, and in case a practical realization is preferred, the description has been attached of a set of drawings, in which the described below has been represented by way of non-limitative example.

DETAILED DESCRIPTION OF THE PREFERRED EMBODIMENT

The present invention relates to systems which enable easy installation and protection of wires and other electrical components in luminaries, lamps and lamp fixtures. Similar numerals designate similar items in all the drawings.

Figure 1:
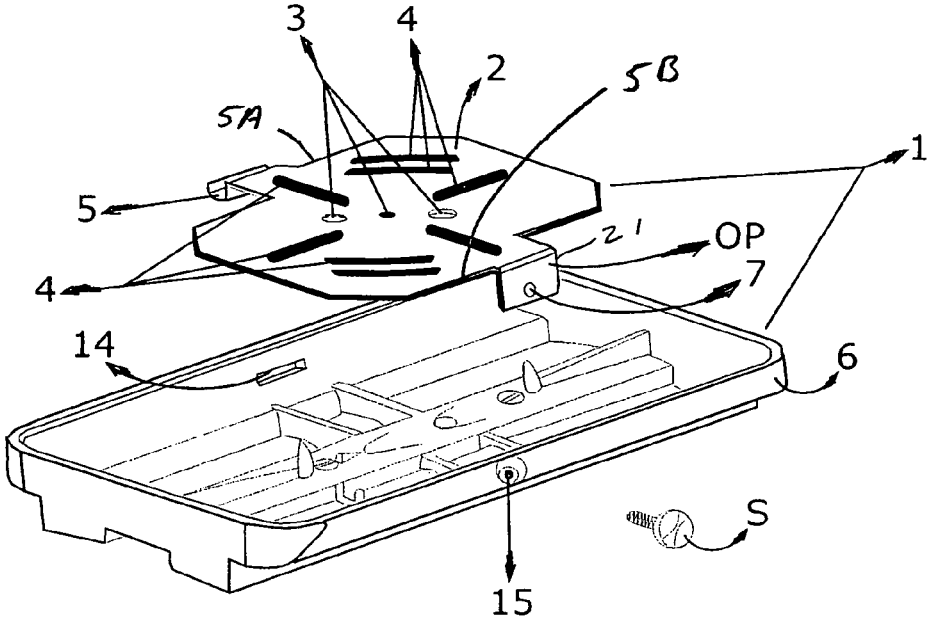
FIG. 1 shows an exploded view of the canopy and plate mounting device for the ceiling or outlet box.
Figure 2:
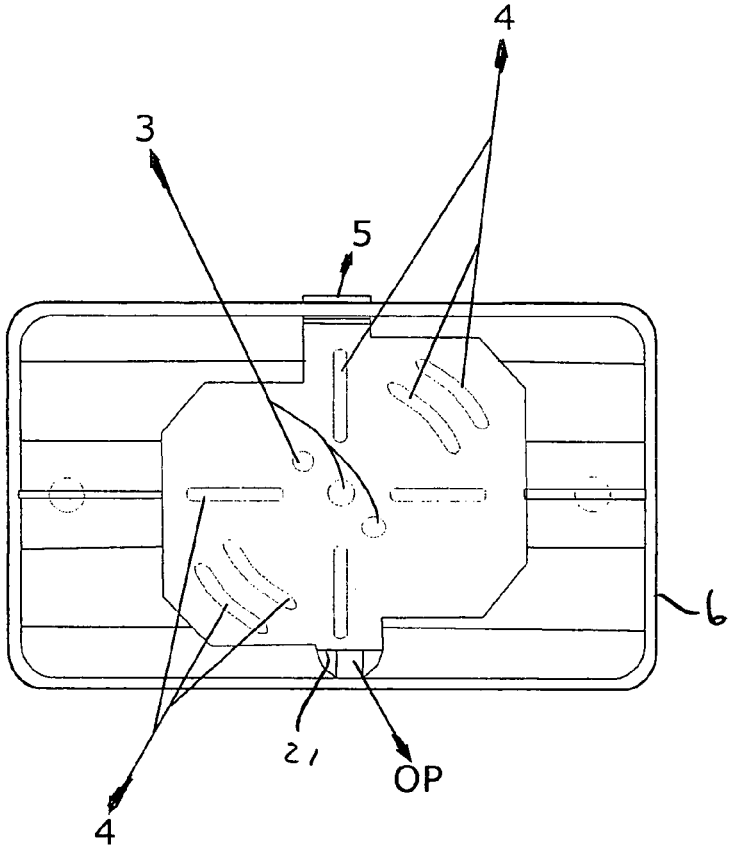
FIG. 2 shows a top view of the canopy and plate mounting device.
Figure 3:
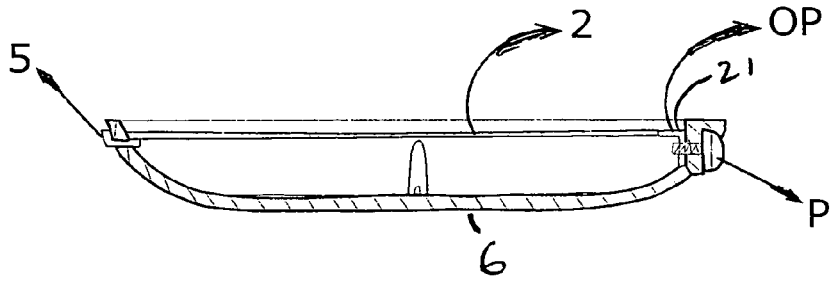
FIG. 3 shows a transverse cut of the complete set, plate mounting device and canopy.
Figure 4:
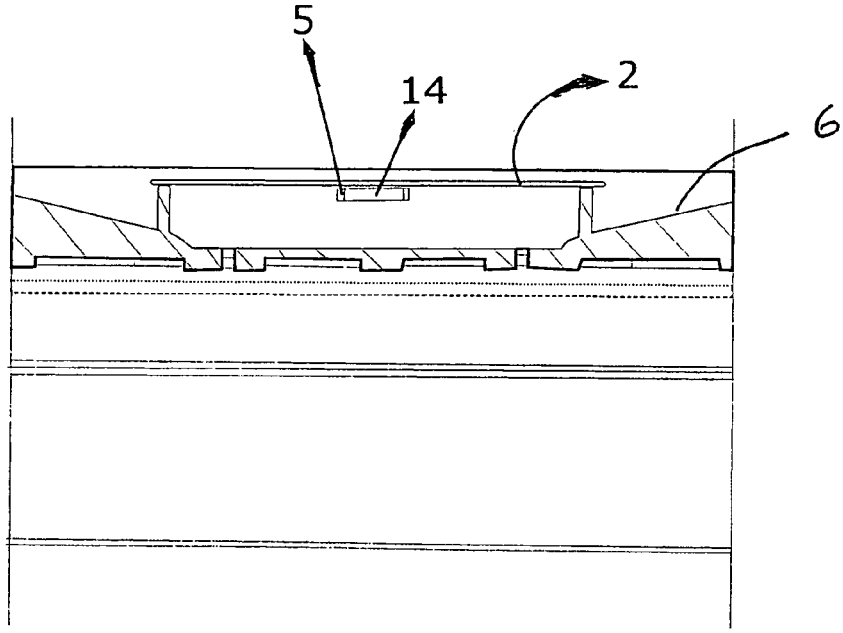
FIG. 4 shows a longitudinal cut of the plate mounting device and canopy.

FIGS. 1–4 show a canopy 6 for a luminary, lamp or lamp fixture. FIG. 1 shows plate 2 above canopy 6. FIG. 2 is a top view of the plate 2 and canopy 6. FIG. 3 is a side or transverse view of canopy 6 and plate 2 from the perspective of a transverse line generally through hook 5 and L-shaped bracket 21. FIG. 4 is a partial, longitudinal view of the plate 2 and canopy 6. The system consists of a set 1 basically composed of two parts. One is a pressed metal plate 2 made from preferably steel or another appropriate material, equipped with at least three circular holes 3 and two groups of concentric oblong and symmetric holes 4. It is also equipped with at least one preferably hook-shaped extension 5 on one of the side edges 5A of the plate 2 and one preferably L-shaped opposite extension (OP), see L-portion 21 on side 5B of plate 2, which has a fixing means, such as a hole 7 for being used with a screw, in order to fix the mounting device 2 to the canopy 6. The canopy 6 is open on top and has a side rectangular slot 14 appropriate to receive the said hook-shaped extension 5 of the mounting device 2, and on the opposite side from the rectangular slot 14, a fixing means is applied, such as round hole 15 for being used with a screw S.

Plate 2 is configured to cover an outlet through which extends electrical wiring for the luminary, lamp or lamp fixture.

The plate 2 equipped with at least three circular holes 3 for passing wires and two sets of oblong symmetric concentric holes used for fixing the luminary or lamp fixture to the ceiling or outlet box (not shown). Two extensions 5, 21 on plate 2 are placed on opposite sides of the plate. The hook-shaped extension 5 holds the canopy 6 while the installer connects the wires extending through holes 3. The L-shaped extension 21 (OP) has a threaded hole 7 for screwing the installation device via screw S to the canopy 6. For fixing this mounting device to the canopy, the canopy 6 must be open on top and have a side rectangular slot 14 appropriate to receive the hook extension 5 from the mounting device (plate 2), and have a preferably round hole 15 equipped with a screw S, which screw must be appropriate for fitting into the hole 7 of the L-shaped extension 21 of the mounting device (plate 2).

For fast and efficient installation, the plate mounting device 2 should first be fixed to the ceiling by fixing elements (not shown) that go through the holes 4 of the plate device 2, whose ultimate function is to hold the canopy.

The rectangular slot 14 on the side of the canopy 6 fits into the side hook extension 5 of the plate mounting device 2, and this aligns the hole 15 of the canopy 6 with the hole 7 of the L-shaped extension 21 on the opposite side of the mounting plate 2 from hook 5, but the canopy 6 should not yet be completely screwed to the mounting device.

Next, all the installer has to do is to connect the wires, rotate the canopy 6 up to align the screw holes 7, 15 of the mounting plate and the L-shaped extension, insert the screw S and close the canopy 6 by screwing it to the mounting device 2.

In this manner, an efficient and fast installation may be obtained without the need of assistance.

Figure 5:
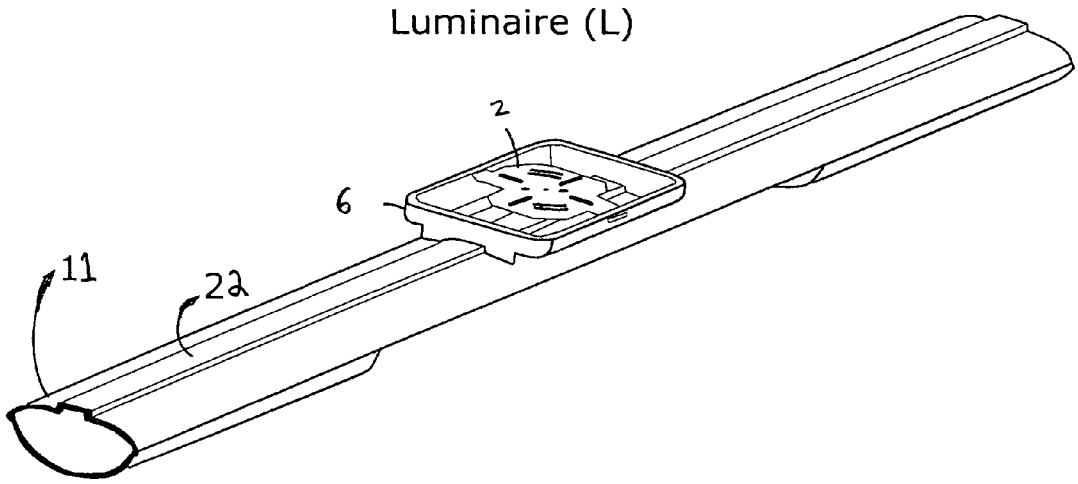
FIG. 5 shows the top perspective view of a luminary (lamp or lamp fixture) set.
Figure 6:
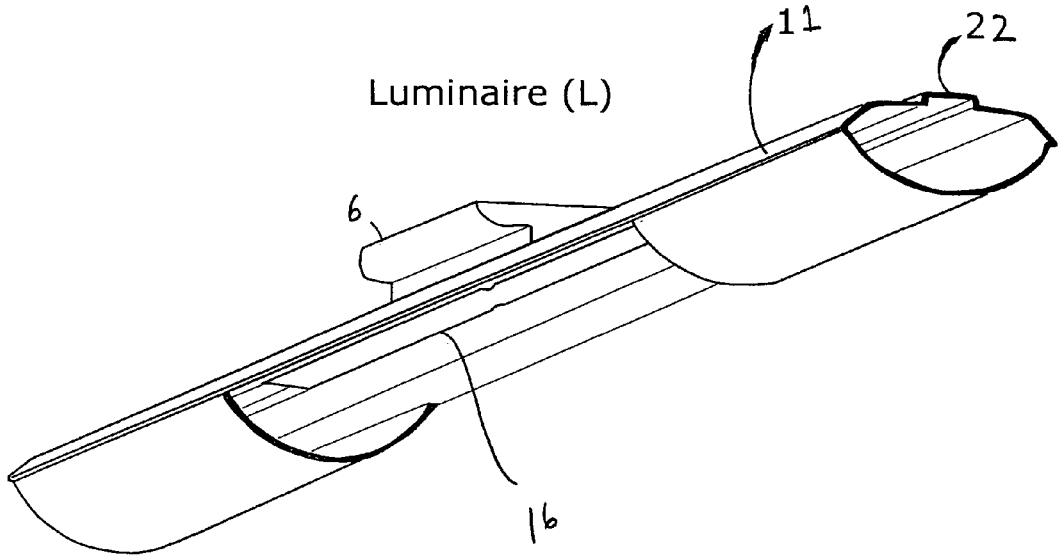
FIG. 6 shows the bottom perspective view of a luminary set.
Figure 7:
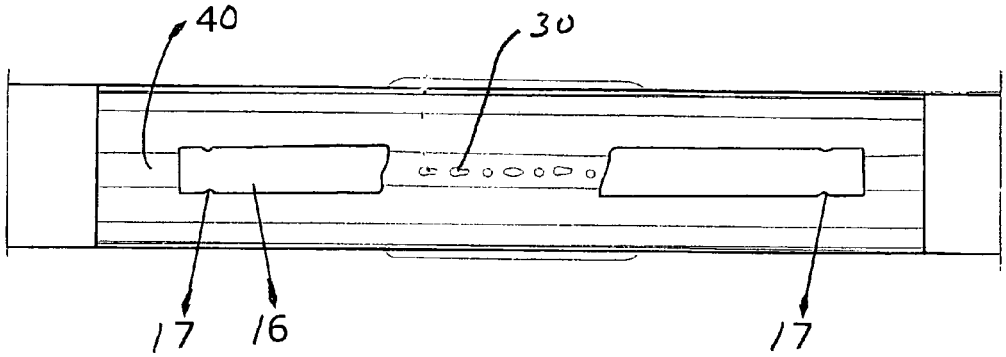
FIG. 7 shows the partial bottom view of a luminary set illustrating the holes of the wire channel of the trough.
Figure 8:
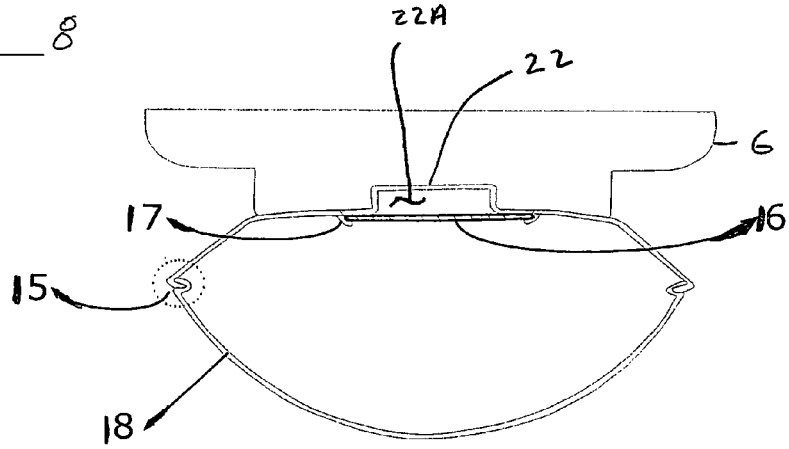
FIG. 8 shows the transverse cut of a luminary set illustrating the protection plate fixed by tabs.
Figure 9:
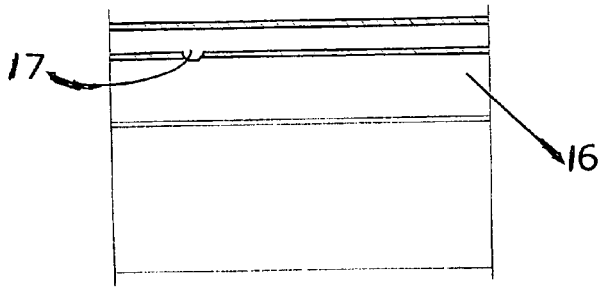
FIG. 9 shows the partial longitudinal cut of a protection plate with fixing tabs, and wire channel.

The structural device introduced into a trough profile with a wiring-protection profile intended to be used in luminaries and the like is shown in FIGS. 5–9. FIGS. 5 and 6 show the major components of the lamp fixture. FIG. 7 shows the underside of the upper part of the luminary. FIG. 8 is a transverse view of the fixture and FIG. 9 is a detail view of the fixing tabs for the metal plate-wire trough cover 16. The device is developed in order to provide more protection and, consequently a longer useful life for electric components, such as wiring, of luminaries and lamps, and to prevent the user from coming in contact with those electric components and wiring. It consists of an upper trough 11 used in luminaries or lamps L preferably made from a rectangular metal plate 2 shaped through stamping or another appropriate process. The upper trough 11 of the fixture is stamped in such a way as to form a rectangular prism-shaped longitudinal wire channel 22A along all the central or longitudinal extension of the upper trough 11. The trough 22, particularly the bottom part of the wire channel (40) is equipped with holes 30 where clips or screws or other mounting devices from the canopy 6 can be fitted. A rectangular metal plate 16 is applied and fixed to the inner surface of the trough 11 by fixing tabs 17. The upper trough 11 is made in such a way as to allow the end lower trough (18, FIG. 8) that closes the luminary set L to slide through longitudinal edge rails or edge folds 15 of the upper trough 11 and make them fit in to one another. The edge rail system is a single edge in the upper trough (see FIG. 8) and a complementary C-shaped edge rail in the lower trough.

The luminary or lamp fixture has a downwardly open trough profile 22 (see cross-sectional view of FIG. 8) forming a wire channel 22A and a wiring-protection profile intended to be used in luminaries, lamps or lamp fixtures and the like. Channel 22A is closed by plate 16 and plate 16 is fixed thereto by tabs 17. The device consists of an upper trough 11 made from a preferably rectangular metal plate shaped through stamping or another appropriate process in such a way as to form wire channel trough 22 and a rectangular prism-shaped longitudinal wire channel 22A intended for holding lamp wiring therein.

For effective protection of the wires that run in the channel 22A obtained from the said protrusion 22, a metal plate 16 with longitudinally-folded "C"-shaped edges is applied and fixed to the inner surface of the trough 22, in order to hold and protect wiring. Plate 16 may be fixed through pressure or sliding, which makes it easy to conduct any necessary maintenance.

The wire channel 22A has been conceived to hold and protect all the wiring (not shown) necessary for connecting the components of the luminary or lamp fixture and to receive all the supports for fixing terminals of lamps and ballast supports. It also allows the application of appropriate reflective materials like PVC film with aluminum coating, in order to better reflect luminosity, thus helping to save electric energy.

The upper trough 11 is made in such a way as to allow the lower trough 18 that closes the luminary set L to slide through longitudinal edge rails or edge folds 15 of the upper trough 11 and make them fit in to one another.

Figure 10:
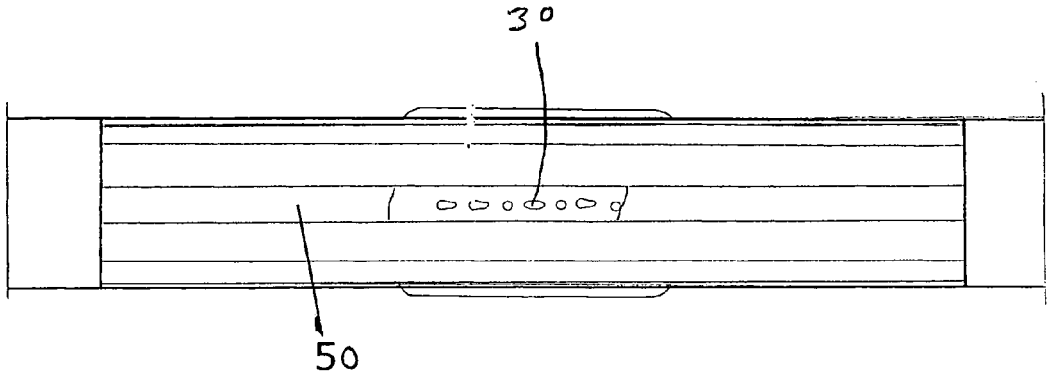
FIG. 10 shows the partial bottom view of a luminary set illustrating the holes of the wire channel of the trough.
Figure 11:
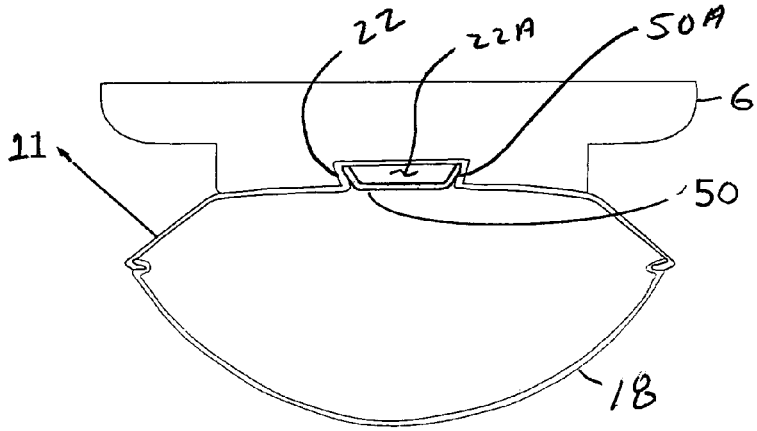
FIG. 11 shows the transverse cut of a luminary set illustrating the angular protection plate with longitudinal folds, equipped with fitting and fixing means, such as pressure or sliding.
Figure 12:
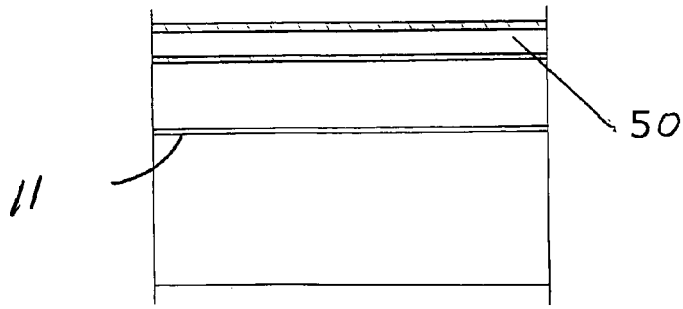
FIG. 12 shows the partial longitudinal cut of a protection plate and wire channel.

The structural device introduced into a trough profile with a wire channel and a wiring-protection profile intended to be used in luminaries and the like is shown in FIGS. 10–12 and provides more protection and, consequently a longer useful life for electric components, such as wiring, of luminaries, lamps and lamp fixtures and the like, and to prevent users from coming into contact with them. FIG. 10 is a bottom view of the system, FIG. 11 is a transverse view and FIG. 12 is a partial, longitudinal view of the system. This embodiment of the invention consists of an upper trough 11 intended to be used in luminaries L made from a rectangular preferably metal plate shaped through stamping or another appropriate process. The upper trough 11 is stamped in such a way as to form a rectangular prism-shaped longitudinal wire channel 22 along all the central extension of the upper trough 11. The bottom part of the wire channel 22A is equipped with holes 30 where clips from the canopy 6 can be fitted. A metal plate 50 with longitudinally-folded "C"-shaped edges 50A, is applied and fixed to the inner surface of the trough 22A through pressure or sliding.

In this further embodiment, a structural device is introduced into a trough profile 11 with a wire channel 22A and a wiring-protection profile intended to be used in luminaries (lamps and lamp fixtures) and the like. This device consists of an upper trough 11, with a defined through profile 22 (see FIG. 5) made from a preferably rectangular metal plate shaped through stamping or another appropriate process in such a way as to form a rectangular prism-shaped longitudinal wire channel 22A intended for holding wiring.

For effective protection of the wires (not shown) that run in the channel 22A (FIG. 11) obtained from the said protrusion, a metal plate 50 with longitudinally-folded "C"-shaped edges 50A is applied and fixed to the inner surface of the trough 22, in order to hold and protect wiring. It may be fixed through pressure or sliding, which makes it easy to conduct any necessary maintenance.

The wire channel 22A has been conceived to hold and protect all the wiring necessary for connecting the components of the luminary and to receive all the supports for fixing terminals of lamps and ballast supports. It also allows the application of appropriate reflective materials like PVC film with aluminum coating on plate 50, in order to better reflect luminosity, thus helping to save electric energy.

The upper trough 11 is made in such a way as to allow the end lower trough 18 that closes the luminary set to slide through longitudinal edge rails or edge folds of the upper trough and make them fit in to one another. See the detail in FIG. 8.

The claims appended hereto are meant to cover modifications and changes within the scope and spirit of the present invention.

What is claimed is:

1. A mounting device for ceiling luminaries, lamps and lamp fixtures comprising:

a metal plate, equipped with at least three circular holes and two groups of concentric oblong and symmetric electrical outlet mounting holes;

said plate having at least one hook-shaped extension on one side edge of said plate and an L-shaped extension on an opposite side of said plate;

a canopy;

said L-shaped extension has a fixing means thereon, in order to fix said plate to said canopy;

said canopy being open at its top and having a side rectangular slot appropriate to receive said hook-shaped extension of the plate, said canopy having, on the opposite side from said rectangular slot, complimentary means for said fixing means.

2. A mounting means as claimed in claim 1 wherein said plate is made from steel or other metal.

3. A mounting means as claimed in claim 1 wherein said fixing means is a hole for use with a screw.

4. A mounting means as claimed in claim 1 wherein said complimentary means is a complimentary hole for use with a screw.

5. A mounting means as claimed in claim 2 wherein said fixing means is a hole for use with a screw.

6. A mounting means as claimed in claim 5 wherein said complimentary means is a complimentary hole for use with said screw.

7. A mounting device for a ceiling luminary or lamp comprising:

a metal plate with a plurality of wire through passages and a plurality of electrical outlet mounting holes;

said plate having a first side and an opposite second side, a hook-shaped extension said first side of said plate and an L-shaped extension on said second side of said plate;

a canopy for said luminary or lamp;

fixing means on said L-shaped extension for fixing said plate to said canopy; and said canopy having a receiving slot for said hook-shaped extension of said plate, said receiving slot and said hook-shaped extension permitting rotation of said canopy during installation.

8. A luminary or lamp fixture with a trough profile with a wiring-protection plate adapted to be mounted onto a canopy comprising:

an elongated upper trough forming a rectangular prism-shaped longitudinal wire channel, a bottom part of said wire channel having a plurality of holes for mounting said upper trough on said canopy;

a rectangular cover plate mounted onto an inner surface of the upper trough by fixing tabs;

an elongated lower trough that engages and closes with said upper trough by sliding through longitudinal edge rails or edge folds formed on said upper trough.

9. A luminary or lamp fixture as claimed in claim 8 wherein said upper trough is made from a rectangular metal plate shaped through stamping or another appropriate process.

10. A luminary or lamp fixture as claimed in claim 8 wherein said edge rails are formed as an edge riding in a complimentary C-shaped edge rail.

11. A luminary or lamp fixture as claimed in claim 8 wherein said cover plate is metal.

12. A luminary or lamp fixture with a trough profile with a wiring-protection plate adapted to be mounted onto a canopy comprising:

an elongated upper trough forming a rectangular prism-shaped longitudinal wire channel, a bottom part of said wire channel having a plurality of holes for mounting said upper trough on said canopy;

a plate with longitudinally-folded C-shaped edges mounted onto an inner surface of the upper trough either through pressure or sliding;

an elongated lower trough that engages and closes with said upper trough by sliding through longitudinal edge rails or edge folds formed on said upper trough.

13. A luminary or lamp fixture as claimed in claim 12 wherein said upper trough is made from a rectangular metal plate shaped through stamping or another appropriate process.

14. A luminary or lamp fixture as claimed in claim 12 wherein said edge rails are formed as an edge riding in a complimentary C-shaped edge rail.

15. A luminary or lamp fixture as claimed in claim 12 wherein said cover plate is metal.

* * * * *